US008007574B2

(12) United States Patent
Iwano et al.

(10) Patent No.: US 8,007,574 B2
(45) Date of Patent: Aug. 30, 2011

(54) AIR CONDITIONER

(75) Inventors: Shun Iwano, Kanagawa (JP); Nobutaka Nakahen, Kanagawa (JP)

(73) Assignee: Fujitsu General Limited, Kawasaki-shi (JP)

( * ) Notice: Subject to any disclaimer, the term of this patent is extended or adjusted under 35 U.S.C. 154(b) by 928 days.

(21) Appl. No.: 11/217,312

(22) Filed: Sep. 2, 2005

(65) Prior Publication Data

US 2006/0096459 A1 May 11, 2006

(30) Foreign Application Priority Data

Sep. 3, 2004 (JP) ..... P.2004-256488
Jan. 14, 2005 (JP) ..... P.2005-007291

(51) Int. Cl.
*B01D 39/00* (2006.01)

(52) U.S. Cl. ..... 96/224; 96/16; 96/55; 96/96; 55/296; 55/300; 55/490; 55/495; 55/503

(58) Field of Classification Search ..... 96/224, 96/16, 96, 55; 55/351–354, 282, 287, 295, 55/296, 297, 300, 385.1, 490, 495, 503; 165/159, 165/65; 95/273; 422/121–122
See application file for complete search history.

(56) References Cited

U.S. PATENT DOCUMENTS 4,373,576 A * 2/1983 Strupczewski ..... 165/48.1
5,217,513 A * 6/1993 Armbruster ..... 96/414
2003/0217561 A1* 11/2003 Shindo et al. ..... 62/264
2004/0000160 A1 1/2004 Takashima et al.
2004/0007000 A1* 1/2004 Takeda et al. ..... 62/78
2004/0013583 A1* 1/2004 Burkhardt ..... 422/186.3
2005/0145109 A1* 7/2005 Dancey et al. ..... 95/273
2005/0211415 A1* 9/2005 Arts et al. ..... 165/59
2007/0084350 A1* 4/2007 Parker et al. ..... 96/224

FOREIGN PATENT DOCUMENTS

EP 1 376 024 A1 1/2004
JP 03-213919 9/1991
JP 10-009661 A 1/1998
JP 10-281485 A 10/1998
JP 11-182881 A 7/1999
JP 11-319456 A 11/1999
JP 2000-320854 A 11/2000

(Continued)

OTHER PUBLICATIONS

Chinese Office Action, issued in Application No. 200510098568.2, dated Oct. 10, 2008.

*Primary Examiner* — Jason M Greene
*Assistant Examiner* — Karla Hawkins
(74) *Attorney, Agent, or Firm* — Venable LLP; Michael A. Sartori; Steven J. Schwartz

(57) ABSTRACT

An air conditioner having an interior casing in which an air filter is provided along an inner face of an air suction inlet, includes a filter cleaning part, a cleaning time drive member for moving the air filter and the filter cleaning part with respect to each other, and an ultraviolet light irradiation unit which irradiates the air filter with ultraviolet rays. The air filter and the filter cleaning part are relatively moved by the cleaning time drive member to remove dust adhered to the air filter, and the ultraviolet light irradiation unit irradiates an uncleaned face of the air filter with the ultraviolet rays.

6 Claims, 2 Drawing Sheets

FOREIGN PATENT DOCUMENTS

| | | | |
|---|---|---|---|
| JP | 2003-185180 | | 7/2003 |
| JP | 2004-001616 | | 1/2004 |
| JP | 2004-28487 | | 1/2004 |
| JP | 2004-036922 | | 2/2004 |
| JP | 2004-044840 | | 2/2004 |
| JP | 2005-351536 | A | 12/2005 |
| WO | WO-2004/011041 | A2 | 2/2004 |

* cited by examiner

AIR CONDITIONER

This application claims foreign priority under 35 USC 119 based on Japanese Patent Applications 2004-256488, filed Sep. 3, 2004, and 2005-007291, filed Jan. 14, 2005, the contents of which are incorporated herein by reference. This priority claim is being made concurrently with the filing of this application.

BACKGROUND OF THE INVENTION

1. Technical Field

The present invention relates to an air conditioner having an air filter for collecting dust, the air filter being located inside an air suction inlet in a casing of an interior unit. More particularly, the invention relates to the air conditioner in which dust adhered to the air filter can be collected while being sterilized and deodorized.

2. Background Art

An air conditioner (an interior unit) is provided with a filter for collecting dust, to prevent the dust from flowing into the air conditioner through an air suction inlet. Generally, this filter is detachably mounted on the interior unit, so that a user can dismount and clean the filter as appropriate. The filter can be re-mounted by the user, after being cleaned.

However, the related art has various disadvantages. For example, the air conditioner is generally installed at a high position in a room. As a result, dismounting the filter is difficult and troublesome. Accordingly, the applicant has proposed air conditioners in which the work for cleaning the filter has been automated.

Japanese Patent Publication No. 2004-28487 discloses, as an example, an air conditioner that includes, in a part of the interior unit, a box-shaped filter cleaning part (a dust box) having cleaning brushes. The dust box has two cleaning brushes for cleaning a front face of the filter (a side opposed to the air suction inlet), and one cleaning brush for cleaning a back face thereof (a side opposed to a heat exchanger), at three positions in total.

According to this related art air conditioner, by reciprocally moving the filter to and from the interior unit through the dust box, dust adhered to the filter will be scraped away by the cleaning brushes inside the dust box, and the scraped dust can be stored inside the cleaning part.

An inside of the interior unit of the air conditioner tends to become moist due to drain water generated from the heat exchanger. As a result, mold or the like forms therein. Therefore, antifungal and antimicrobial treatments are applied to the dust box. However, there is a problem in that only the dust in contact with an inner wall of the dust box can be sterilized, and substantially all of the dust collected in the dust box is not sterilized.

SUMMARY OF THE INVENTION

Under the circumstances, the below-disclosed embodiment has been made to solve the at least the above described problem. It is an object of the invention to provide an air conditioner in which dust adhered to an air filter can be collected while conducting sterilizing and deodorizing treatments. However, the embodiments may be realized in the situation when other objects are achieved, or when no objects at all are achieved.

The invention has several features as described below. The invention includes an air conditioner comprising an interior unit casing having an air suction inlet and an air blowing outlet, and provided with an air filer along an inner face of the air suction inlet, characterized in that the interior unit casing includes a filter cleaning part, a cleaning time drive member for moving the air filter and the filter cleaning part relatively to each other, and an ultraviolet light source which irradiates the air filter with ultraviolet rays, wherein when the air filter and the filter cleaning part are relatively moved by the cleaning time drive member to remove dust adhered to the air filter, an uncleaned face of the air filter is irradiated with the ultraviolet rays from the ultraviolet light source.

The invention also includes an air conditioner comprising an interior unit casing having an air suction inlet and an air blowing outlet, the interior unit casing being provided with an air filter along an inner face of the air suction inlet, and a heat exchanger in an air passage between the air suction inlet and the air blowing outlet, characterized in that the air filter contains a photo-catalyst, and the interior unit casing has a filter cleaning part which includes a cleaning brush contained in a dust box surrounding both front and back faces of a part of the air filter, a cleaning time drive member for moving either one of the air filter and the filter cleaning part, and an ultraviolet light source which irradiates the air filter with ultraviolet rays thereby to excite the photo-catalyst, wherein the cleaning time drive member moves the air filter or the filter cleaning part relatively to each other while irradiating the air filter with the ultraviolet rays, thereby to clean the air filter.

Further, the invention is characterized in that the photo-catalyst includes titanium apatite.

Additionally, the invention is characterized in that the ultraviolet light source is arranged between the air suction inlet and the heat exchanger.

The invention is further characterized in that the ultraviolet light source is arranged at a side of the air suction inlet, and a reflection part which reflects the ultraviolet rays emitted from the ultraviolet light source is arranged at a side of the heat exchanger interposing the air filter.

Also, the invention is characterized in that the ultraviolet light source is arranged at a side of the heat exchanger, and a reflection part which reflects the ultraviolet rays emitted from the ultraviolet light source is arranged at a side of the air suction inlet interposing the air filter.

Further, the invention is characterized in that the ultraviolet light source includes an ultraviolet light emitting element which emits the ultraviolet rays having a wavelength, and a holder for holding the ultraviolet light emitting element, wherein a terminal part of the ultraviolet light emitting element is integrally molded with a part of the holder.

The invention is also characterized in that the ultraviolet light source is provided inside the filter cleaning part.

Also, the invention is characterized in that a cleaned face of the air filter which has been already cleaned by the filter cleaning part is also irradiated with the ultraviolet rays from the ultraviolet light source.

Additionally, the invention is characterized in that there are at least two cleaning modes as filter cleaning modes, namely, a first cleaning mode and a second cleaning mode, wherein moving velocity of the air filter or the filter cleaning part relative to each other in the second cleaning mode is different from that in the first cleaning mode.

According to the invention, when the air filter and the filter cleaning part are relatively moved by the cleaning time drive member to remove the dust adhered to the air filter, an uncleaned face of the air filter is irradiated with the ultraviolet rays from the ultraviolet light source. Consequently, the dust will be removed from the air filter in a sterilized and deodorized state. Therefore, when the dust is collected and stored in the dust box, the dust box can be kept clean. Moreover, when the dust is disposed outdoors, for example, byway of an exhaust pipe or the like, an exhaust passage can be kept clean.

According to the invention, the ultraviolet light source irradiates the air filter with the ultraviolet rays, thereby exciting the photo-catalyst in the air filter, and active oxygen is generated. By decomposing reaction of the active oxygen (photo-catalyst reaction), bacteria and offensive smell of the dust adhered to the air filter will be decomposed by oxidation, and the dust in a sterilized and deodorized state can be collected into the dust box.

Also according to the invention, wherein titanium apatite is used as the photo-catalyst to be applied to the air filter, it is possible to obtain the photo-catalyst easily and at a substantially low cost and maintain its effect for a substantially long time, because the photo-catalyst can be regenerated by the ultraviolet light irradiation.

According to the invention, wherein the ultraviolet light source is provided in the air passage, it is possible to prolong a life of the ultraviolet light source, because the ultraviolet light source that can become hot is cooled by air.

According to the invention, wherein the ultraviolet light source is arranged at the side of the air suction inlet, and fins of the heat exchanger arranged at an opposite side interposing the air filter are utilized as the reflection part, it is possible to efficiently irradiate the air filter with the ultraviolet rays.

According to the invention, wherein the ultraviolet light source is arranged at the side of the heat exchanger, and the reflection part is arranged at the side of the air suction inlet interposing the air filter, it is possible to irradiate the air filter uniformly with the ultraviolet rays, and to enhance the photo-catalyst reaction.

According to the invention, wherein a terminal part of the ultraviolet light emitting element is molded with the holder, a short circuit will not happen even though condensation has occurred, and it is possible to prevent an intrusion of static electricity, hence eliminating a breakdown.

According to the invention, wherein the ultraviolet light source is provided inside the filter cleaning part, it is possible to sterilize and deodorize the dust collected in the filter cleaning part, and to keep the inside of the filter cleaning part clean. Moreover, when the filter cleaning part is constructed as movable, the ultraviolet light source can also move together, and there will be no necessity of providing a particular moving member.

According to the invention, wherein a cleaned face of the previously cleaned air filter cleaned by the filter cleaning part is also irradiated with the ultraviolet rays from the ultraviolet light source, it is possible to keep the air filter hygienic. Moreover, when the air filter contains the photo-catalyst, it is also possible to regenerate the photo-catalyst.

According to the invention, wherein there are at least two filter cleaning modes, namely, a first cleaning mode and a second cleaning mode, wherein the moving velocity of the air filter or the filter cleaning part relative to each other in the second cleaning mode is different from that in the first cleaning mode, it is possible to select the mode having the slower moving velocity, according to an amount of the dust on the air filter, thereby to clean the air filter more carefully.

DETAILED DESCRIPTION OF THE PREFERRED EMBODIMENTS

Figure 1:
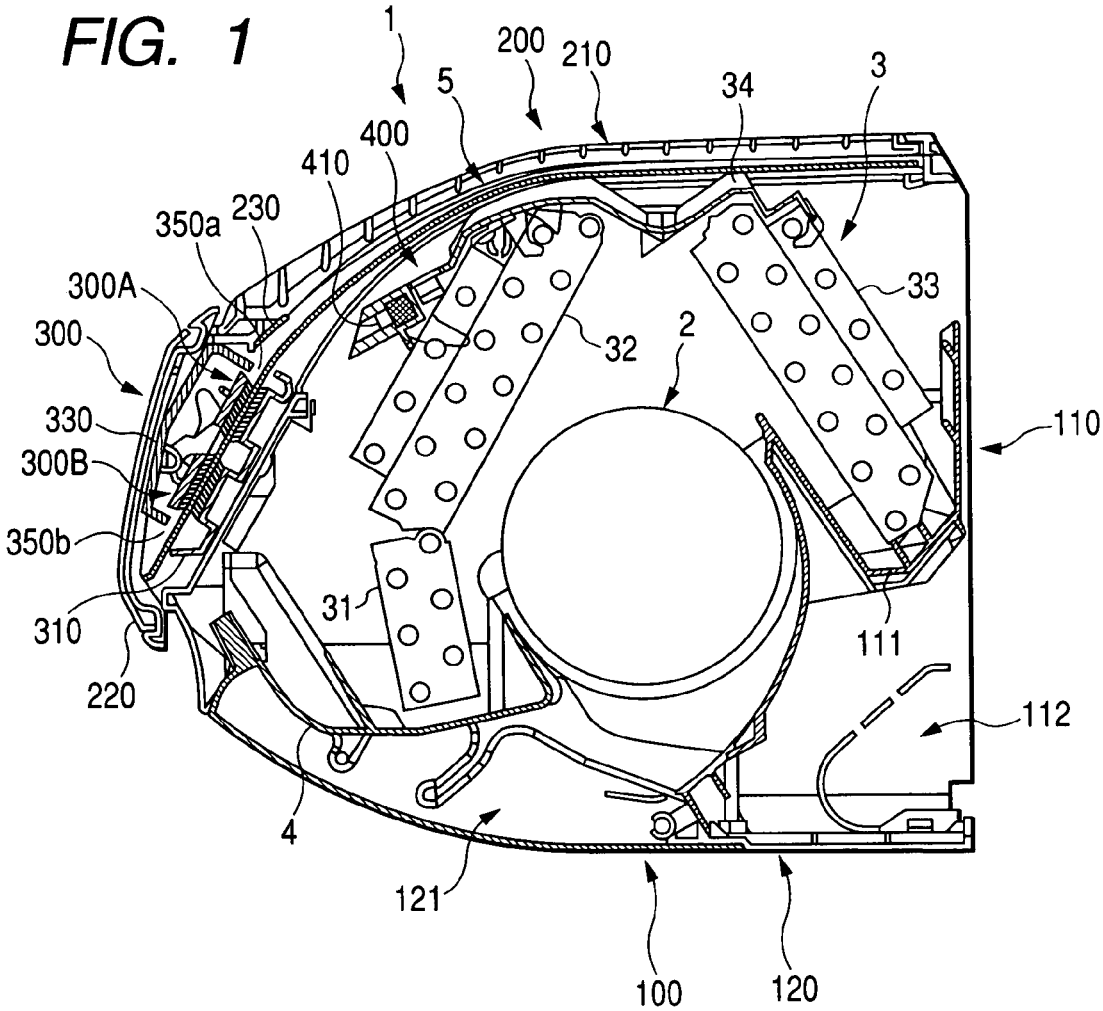
FIG. 1 is a sectional view showing an essential part of an air conditioner (an interior unit) in an exemplary, non-limiting embodiment.

Now, an exemplary, non-limiting embodiment of the air conditioner will be described referring to the drawings. FIG. 1 is a sectional view showing an essential part of the air conditioner (an interior unit) in an exemplary, non-limiting embodiment.

The interior unit 1 includes a base panel 100 installed on a wall face by fitting metals (not shown), and an upper panel 200 attached to the base panel 100 so as to cover the base panel 100 from an upper face to a front face thereof. Both panels 100, 200 are formed of synthetic resin.

The base panel 100 includes a back panel 110 which is parallel to the wall face, and an under panel 120 that protrudes forward from a lower end of the back panel 110. The base panel 100 is formed in an L-shape in a sectional view.

Although not shown, the base panel 100 is provided with a pair of side plates on the left side and the right side. A cross flow fan 2 as an air blowing fan and a heat exchanger 3 are supported between the two side plates. Further, a drain pan 4 is mounted across the two side plates.

The heat exchanger 3 includes three heat exchanger units 31 to 33 assembled in a substantially lambda (λ) shape, and arranged to cover an upper part of the cross flow fan 2.

The heat exchanger units 31, 32 at a front side and the heat exchanger unit 33 at a back side are connected at their top parts by a connecting plate 34. The connecting plate 34 functions also as a block board for preventing sucked air from bypassing the heat exchanger 3. Adjacent to one of the side plates of the base panel 100, there is provided an electrical component box (not shown) that includes various types of electric power units and electronic components for driving the interior unit 1.

The back panel 110 is provided with a water receiving part 111 for receiving drain water generated from the back side heat exchanger unit 33. A storage part 112 that includes pipes and electric wires of various types is provided below and behind the water receiving part 111.

The under panel 120 is provided with an air blow outlet 121 for blowing out the air to the room by blowing action of the cross flow fan 2. The air blow outlet 121 includes upper and lower wind directing plates, and right and left wind directing plates for changing blowing directions of the air. In addition, a diffuser adapted to open in a direction of a floor, at a time of rapid warming operation or rapid cooling operation for example, may be provided (not shown).

The upper panel 200 is locked to an upper end of the back panel 110 of the base panel 100 by locking hooks (not shown) provided at a rear end thereof, and mounted in an arch-like shape up to a forward end of the base panel 100 to cover the heat exchanger 3.

The upper panel 200 is provided with an air suction inlet 210 along substantially an entire face thereof. The air suction inlet 210 may be in a form of grill. An opening area thereof is preferably larger than an upper projected area of the heat exchanger 3.

There is provided, in front of the upper panel 200, an open panel 220 which can be opened by pushing of the air filter 5 moving outward of the interior unit 1. The open panel 220 is rotatable about its upper end side as a pivot. When the air filter 5 moves in a forward direction (i.e., when the air filter 5 is discharged outward of the interior unit 1), a lower end of the open panel 220 is lifted by the air filter 5, whereby the air filter is withdrawn out of the interior unit 1.

Also, in front of the upper panel 200, a drive motor is provided as a filter driving member, and a part of a drive gear connected to the drive motor is exposed from a part of the upper panel 200 (not shown). The drive motor is controlled by a control member (not shown).

Figure 2:
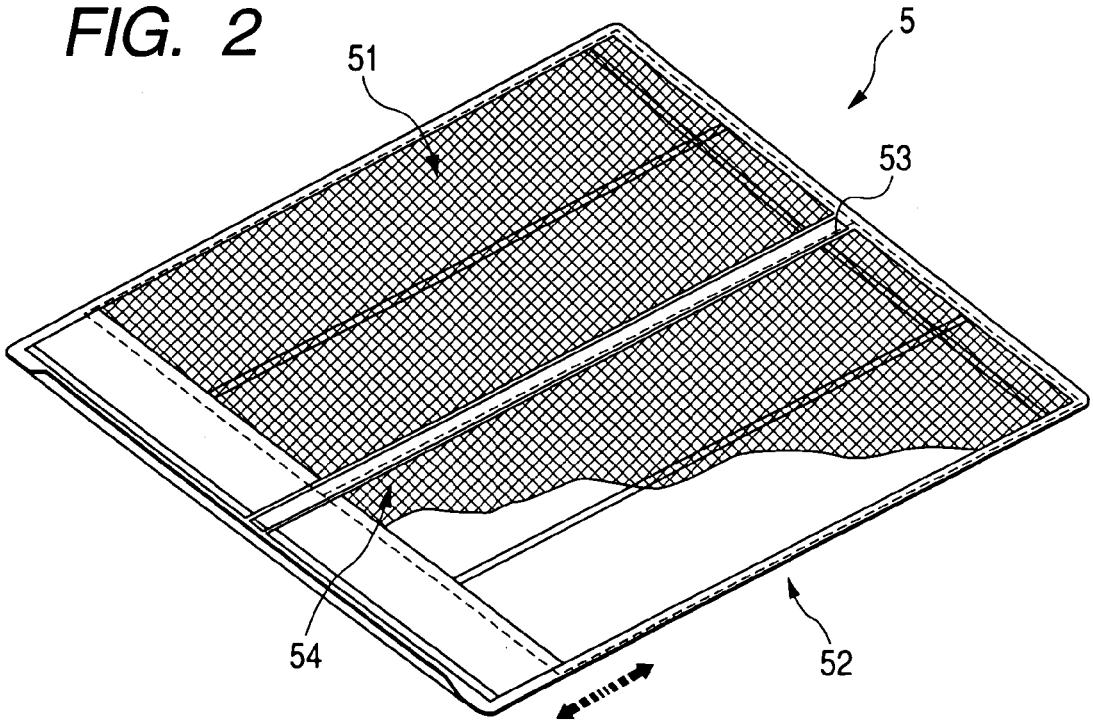
FIG. 2 is a perspective view of an air filter to be mounted on the air conditioner.

The air filter 5 for catching dust in the air is provided along the air suction inlet 210, inside the upper panel 200 (at a side of the heat exchanger 3). As shown in FIG. 2, the air filter 5 includes a filter sheet 51 in a form of a mesh sheet for catching the dust, and a frame 52 which supports the filter sheet 5. A pair of the air filters 5 cover the heat exchanger 3. Only one of the air filters 5 is shown in FIG. 2.

The filter sheet 51 is a sheet body formed of a synthetic resin such as polypropylene, and having a knitted pattern of a mesh size. The filter sheet 51 contains at least titanium apatite as a photo-catalyst.

Titanium apatite is a material that is prepared by substituting titanium, on atomic level, for a part of calcium in apatite, which is excellent for absorbing bacteria and virus. By irradiating titanium apatite with ultraviolet rays, active oxygen will be generated, and the dust adhered to the air filter 5 can be inactivated. Generally, titanium apatite is granular and blended with matrix resin in an amount for use. However, it is possible to mold the filter sheet 51 and the frame 53 in advance, and then, to form a layer of titanium apatite on their surfaces, by applying a coating containing titanium apatite.

Further, additives such as fungicide, antimicrobial agent may be further added to the filter sheet 51. Still further, an electrically conductive material may be added for preventing the filter sheet 51 from being electrified by a brush. Although the filter sheet 51 is formed of polypropylene in this embodiment, it is possible to change the material and the mesh arbitrarily, according to specifications. The amount of titanium apatite to be blended is also arbitrary according to the specifications.

A rail frame 53 is formed in a center part of the frame 52 parallel with a moving direction (a direction of the arrow in FIG. 2) of the air filter 5. On a reverse side of the rail frame 53, a rack gear 54 is formed that is adapted to be engaged with the drive gear (not shown) provided inside the interior unit 1. The air filter 5 is adapted to reciprocally move by a combination of this rack gear and the drive gear.

Preferably, the frame 52 and the rail frame 53 may also contain titanium apatite as the photo-catalyst. More preferably, the additives such as fungicide, antimicrobial agent may be further added to the frame 52 and the rail frame 53. Still further, electrically conductive material may be added for preventing the frame 52 and the rail frame 53 from being electrified by the brush.

The filter sheet 51 is stretched over two openings (filter faces) enclosed by the frame 52 and the rail frame 53. It is possible to integrally mold the filter sheet 51 with the frame 52 by injection molding. However, by putting them together in a same cavity when the frame 52 is molded, it is possible to bond the filter sheet 51 to the frame 52 in an ordinary manner.

A filter cleaning part 300 for removing the dust adhered to the air filter 5 is provided between the upper panel 200 and the open panel 220. In this embodiment, a pair of the air filters 5 is employed in the interior unit 1, as described above. Accordingly, the filter cleaning parts 300, which may be of the same structure, are also provided at two positions.

The filter cleaning part 300 has a dust box including a bottom cover 310 supported by the upper panel 200, and a top cover 330 which covers the bottom cover 310 so as to be opened and closed. When the dust box is formed of synthetic resin, the resin may preferably contain the fungicide and an antimicrobial agent.

The top cover 330 is coupled to the bottom cover 310 by means of a hinge at its one end, and can be opened or closed at the other end. The dust box is provided, at both ends thereof, with filter gates 350*a*, 350*b* for enabling the air filter 5 to enter and exit the dust box.

The dust box is provided, adjacent to one of the filter gates 350*a*, with a cleaning unit 300A which has a pair of opposed cleaning brushes at both sides of the air filter 5, and adjacent to the other filter gate 350*b*, with a cleaning unit 300B which has a pair of opposed cleaning brushes at both sides of the air filter 5.

Preferably, each pair of the cleaning brushes in the cleaning units 300A and 300B are inclined in a manner opposed to each other, so as to come into contact with the air filter 5 at an angle. For example, the cleaning brushes in the cleaning unit 300A may be inclined toward the left, and the cleaning brushes in the other cleaning unit 300B may be inclined toward the right.

Although in this embodiment, the two cleaning units 300A, 300B each having a pair of the upper and lower cleaning brushes are provided inside the dust box, a specific structure of the filter cleaning part 300 is arbitrary, provided that the dust adhered to the air filter 5 can be collected and stored.

Figure 3:
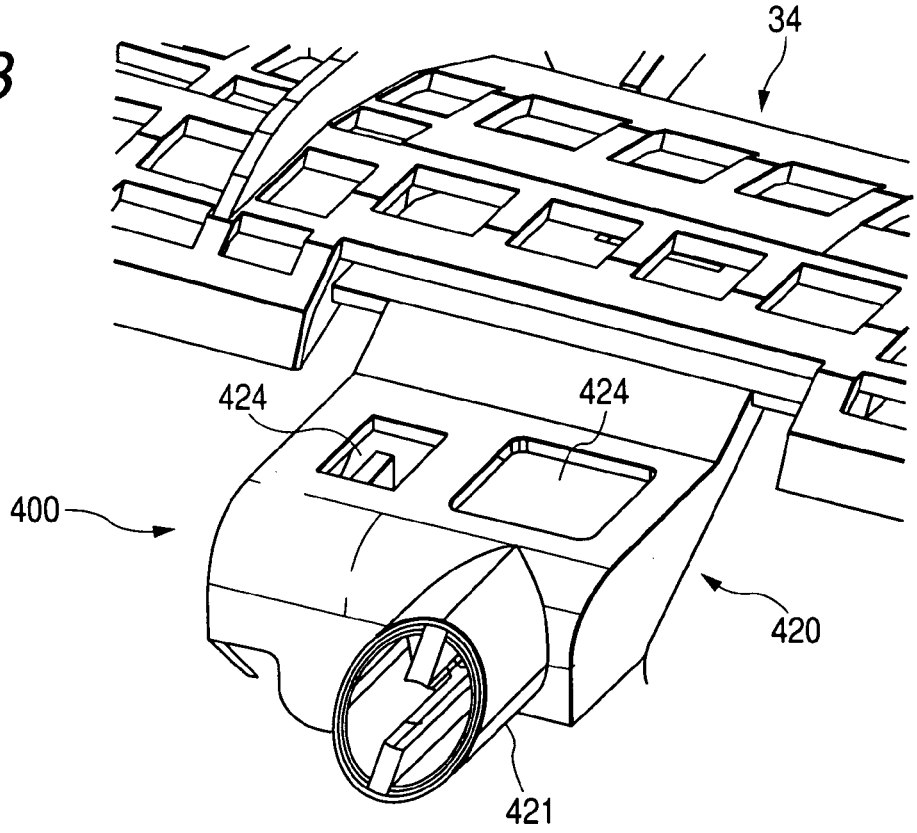
FIG. 3 is an enlarged perspective view of a part of the air conditioner including an ultraviolet irradiation unit.
Figure 4:
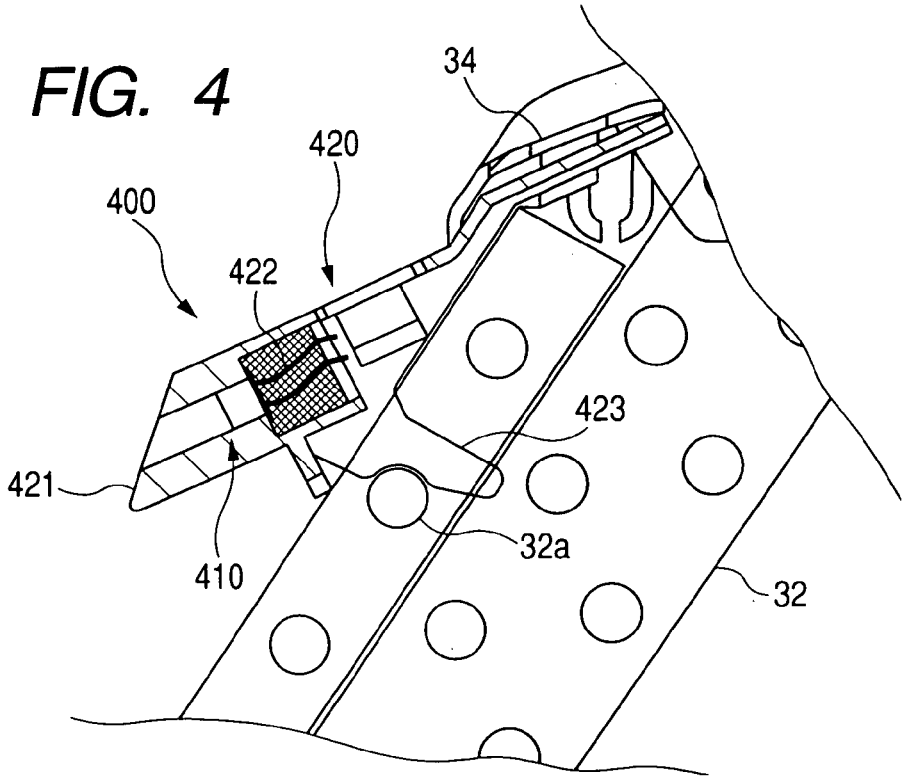
FIG. 4 is an enlarged sectional view of the part including the ultraviolet irradiation unit.

Referring to FIGS. 3 and 4, an ultraviolet irradiation unit 400 is provided inside the interior unit 1, as an ultraviolet light source for irradiating the air filter 5 with ultraviolet rays to excite the photo-catalyst. The ultraviolet irradiation unit 400 includes an ultraviolet lamp 410 for emitting the ultraviolet rays, and a lamp holder 420 that holds the ultraviolet lamp 410.

The ultraviolet lamp 410 includes an ultraviolet light emitting element such as a diamond LED which emits the ultraviolet rays having a specific wavelength, and is driven by a driving circuit which is not shown. As the ultraviolet lamp 410, the ultraviolet light emitting element having a long life and high efficiency may be employed. However, a common ultraviolet lamp may be also employed.

In this exemplary, non-limiting embodiment, the lamp holder 420 is integrally formed as a part of the connecting plate 34 of the heat exchanger 3, so as to extend from one end of the connecting plate 34 along the front side heat exchanger unit 32. A lamp case 421 in a shape of a sleeve for holding the ultraviolet lamp 410 is formed at a forward end of the lamp holder 420.

This lamp case 421 is directed to radiate the ultraviolet rays toward a part of the air filter 5 existing in vicinity of the one of the filter gates 350*a* of the filter cleaning part 300, in other words, an uncleaned part of the air filter 5 before entering into the filter cleaning part 300. A lead terminal of the ultraviolet lamp 410 is drawn out from a back side of the lamp case 421, to form a terminal part 422 connected to the driving circuit (not shown).

The terminal part 422 is formed in a box-like shape having a hollow space inside. The inside of the terminal part 422 is molded with resin so that the ultraviolet lamp 410 may not cause short circuiting due to condensation or the like, or may not cause a breakdown due to static electricity.

The lamp holder 420 is provided with a support plate 423 that supports the lamp holder 420 in a floating manner with respect to the front side heat exchanger unit 32. As shown in FIG. 4, the support plate 423 is a plate member inserted between fins of the front side heat exchanger unit 32, and a part of the support plate 423 is cut out. By hooking the cut out portion on a cooling pipe 32*a*, the lamp holder 420 will be supported in a floating manner.

The lamp holder 420 may be provided in a part of an air passage between the air suction inlet 210 and the heat exchanger 3. In this manner, the ultraviolet lamp 410 can be cooled down with the air, and hence, higher efficiency and longer life of the ultraviolet lamp can be achieved.

The lamp holder 420 is further provided with openings 424 for the purpose of enhancing cooling efficiency. In this embodiment, the openings 424 are provided at two positions. However, a shape, number, and positions of the openings 424 can be changed according to the specifications.

In this embodiment, the ultraviolet irradiation units 400 are provided at four positions at intervals along the connecting plate 34, so that the respective ultraviolet irradiation units 400 can irradiate the air filter 5 with the ultraviolet rays within a range thereof. It is possible to change the positions and number of the ultraviolet irradiation units 400 to be installed, arbitrarily according to the specifications.

Referring back to FIG. 1, a reflection part 230 for uniformly irradiating the air filter 5 with the ultraviolet rays emitted from the ultraviolet lamp 410 is provided in a part of the upper panel 200. The reflection part 230 may be in a form of a strip-like sheet having a mirror finished surface such as an aluminum sheet, and attached to the upper panel 200 at a position substantially opposed to the ultraviolet irradiation unit 400 interposing the air filter 5. The reflection part 230 may be arranged in a strip-like shape along a lateral direction of the upper panel 200.

In this embodiment, the ultraviolet irradiation unit 400 is arranged at a side of the heat exchanger 3, and the reflection part 230 is arranged in a part of the upper panel 200 interposing the air filter 5. However, the ultraviolet irradiation unit 400 may be provided at a side of the upper panel 200, and the fins of the heat exchanger unit 32 interposing the air filter 5 may be utilized as the reflection plate.

Referring to FIG. 1, an example of operation of the filter cleaning part 300 will be described. A part of the air filter 5 always stays inside the filter cleaning part 300. Further, when the air filter 5 is completely withdrawn into the interior unit 1, as shown in FIG. 1, covering all over the air suction inlet 210 of the upper panel 200, this is defined as an initial state.

In the initial state of the air filter 5 as shown in FIG. 1, when a filter cleaning signal is issued from a remote controller for example but not by way of limitation, a control part will issue a command to the driving circuit (not shown) for driving the ultraviolet irradiation unit 400. Then, the ultraviolet lamp 410 will emit the ultraviolet rays toward the air filter 5.

Substantially at the same time, the motor (not shown) will be driven, and the air filter 5 starts to move in a forward direction (in a discharging direction: a leftward direction in FIG. 1). On this occasion, the one filter gate 350*a* will be "an inlet side", and the other filter gate 350*b* will be "an outlet side".

The ultraviolet rays emitted from the ultraviolet lamp 410 irradiate a back face of the air filter 5. At the substantially same time, a part of the ultraviolet rays passes through the mesh to reach the upper panel 200, and is reflected there by the reflection part 230, thereby to irradiate an upper face of the air filter 5. A part of the ultraviolet rays is also reflected by the fins of the heat exchanger unit 32.

When the air filter 5 is irradiated with the ultraviolet rays, the titanium apatite in the air filter 5 becomes excited and the active oxygen is generated. The dust adhered to the air filter 5 will be decomposed by oxidization with this active oxygen, whereby the dust will be sterilized and deodorized.

The then-sterilized and deodorized dust will be scraped away by the cleaning brushes contained in the cleaning unit 300A adjacent to the filter gate 350*a* of the filter cleaning part 300, while the air filter 5 moves, and collected into the dust box of the filter cleaning part 300. Because the dust which has been sterilized and deodorized will be collected into the dust box of the filter cleaning part 300, an inside of the dust box can be kept clean.

On the other hand, the dust remaining on the air filter 5 will be caught by the brushes contained in the cleaning unit 300B adjacent to the filter gate 350*b*. In this manner, the dust adhered to the air filter 5 will be substantially completely removed. Moreover, because the brushes contained in the cleaning unit 300B also function as shutters, the dust stored in the dust box of the filter cleaning part 300 will not be taken out by the air filter 5 to enter into the room.

When the movement of the air filter 5 in the forward direction has finished, the motor (not shown) rotates in a reverse direction, and the air filter 5 starts to move in a backward direction (in a direction of retracting into the interior unit 1). Because the ultraviolet lamp 410 continues to be lit during this backward movement, an already cleaned face of the air filter 5 from which the dust has been removed will be sterilized and deodorized, whereby the air filter 5 can be kept hygienic.

In case where the photo-catalyst such as titanium apatite is contained in the air filter 5, the photo-catalyst will be regenerated by the ultraviolet rays. Therefore, effects of the photo-catalyst can be maintained for a long period.

When the dust box of the filter cleaning part 300 is filled with dust, the filter cleaning part 300 can be taken out by opening the upper panel 200, and the dust stored in the dust box can be sucked up by a vacuum cleaner or the like.

Moreover, although in the above described embodiment, the air filter 5 is so adapted as to move with respect to the filter cleaning part 300 as shown in FIG. 1, it may be so constructed that the ultraviolet irradiation unit 400 moves along the air filter 5, while the position of the air filter 5 is fixed. Further, it may be so constructed that the ultraviolet irradiation unit 400 is arranged inside the dust box of the filter cleaning part 300, and the filter cleaning part 300 moves along the air filter 5.

Still further, at least two modes may be prepared as filter cleaning modes, namely "an ordinary cleaning mode" as a first cleaning mode, and "a careful cleaning mode" as a second cleaning mode. The moving velocity of the air filter 5 in "the careful cleaning mode" is slower than in "the ordinary cleaning mode", so that the air filter 5 may be exposed to the ultraviolet rays for a longer time.

In the above described embodiment, the ultraviolet lamp 410 is adapted to be lit only when the filter is cleaned. However, the ultraviolet lamp 410 may be also lit, for example, during ordinary air conditioning operation, thereby to irradiate the air filter 5 with the ultraviolet rays. In this manner, the air and the dust passing through the air filter 5 can be sterilized and deodorized utilizing the photo-catalyst reaction.

Although in the above described embodiment, the dust is collected and stored in the dust box of the filter cleaning part 300, in case where an exhaust pipe communicated to the outdoors, for example, has been connected to the filter cleaning part 300, it is possible to discharge the dust through the exhaust pipe, without storing the dust in the filter cleaning part 300. Accordingly, an exhaust passage including the exhaust pipe can be kept clean.

Although the embodiment has been heretofore described referring to the interior unit of the air conditioner of a split type in which the interior unit is separated from an exterior unit, and of a sealing wall type, the invention is not limited to this type. The invention can be widely applied to the air conditioner having the air filter, such as a floor installed type air conditioner, and an integral type air conditioner in which the interior unit and the exterior unit are contained in one casing. Moreover, speaking of a heat source, the embodiment can be applied to a gas combustion type air conditioner, a warm water circulation type air conditioner, and soon. Further, it is also possible to apply the embodiment to an air cleaner or a dehumidifier, for example, provided that they have the filter cleaning member.

While the invention has been described above with reference to the embodiment, the technical range of the invention is not restricted to the range described in the embodiment. It is apparent to the skilled in the art that various changes or improvements can be made in the embodiment. It is apparent from the appended claims that the embodiment thus changed or improved can also be included in the technical range of the invention.

What is claimed is:

1. An air conditioner comprising an interior unit casing having an air suction inlet and an air blowing outlet, and an air filter along an inner face of said air suction inlet, said interior unit casing including, a filter cleaning part including a cleaning brush that contacts a first side of said air filter and removes dust adhered to said air filter, and a dust box having a top cover located on the first side of said air filter and a bottom cover located on a second side of said air filter, a member for moving said filter cleaning part relatively to said air filter, a light source located on a first side of said air filter, wherein said light source irradiates the first side of said air filter with ultraviolet rays, when said air filter and said filter cleaning part are moved by the member for moving, to remove said dust, and a reflector located on a second side of said air filter, said second side being a position opposed to the first side interposing said air filter, said reflector adapted to reflect ultraviolet rays irradiated by said light source and passing through said air filter onto the second side of said air filter.

2. An air conditioner as claimed in claim 1, wherein said ultraviolet light source is provided inside said filter cleaning part.

3. An air conditioner as claimed in claim 1, wherein a cleaned face of said air filter that has been cleaned by said filter cleaning part is irradiated with the ultraviolet rays from said ultraviolet light source.

4. An air conditioner as claimed in claim 1, comprising at least a first cleaning mode and a second cleaning mode, wherein a first moving velocity of said air filter relative to said filter cleaning part in the first cleaning mode is substantially different from a second moving velocity of said air filter relative to said filter cleaning part in the second cleaning mode.

5. The air conditioner of claim 1, wherein the air filter comprises a mesh air filter.

6. The air conditioner of claim 1, wherein the light source irradiates a portion of said air filter prior to cleaning with the cleaning part, the member for moving moves the portion of said air filter in a first direction into contact with the cleaning part, the member for moving moves the portion of said air filter in a second direction opposite the first direction and out of contact with the cleaning part, and then the light source irradiates the portion after cleaning with the cleaning part.

* * * * *